United States Patent [19]

Hughes

[11] 4,122,425

[45] Oct. 24, 1978

[54] ELECTRICAL CONNECTIONS FOR EXTREMELY FINE WIRES

[75] Inventor: Donald Wayne Kent Hughes, Mechanicsburg, Pa.

[73] Assignee: AMP Incorporated, Harrisburg, Pa.

[21] Appl. No.: 829,550

[22] Filed: Aug. 31, 1977

[51] Int. Cl.[2] ..... H01F 15/10

[52] U.S. Cl. ..... 336/192; 339/276 R

[58] Field of Search ..... 336/192, 208, 198; 310/71; 339/276 R, 276 C, 276 T, 220 C, 220 R, 223 R; 174/84 C

[56] References Cited

U.S. PATENT DOCUMENTS

| | | | |
|---|---|---|---|
| 2,701,350 | 2/1955 | Soreng | 339/276 T X |
| 2,789,278 | 4/1957 | Soreng | 339/276 T |
| 3,363,224 | 1/1968 | Gluntz | 339/276 T X |
| 3,422,395 | 1/1969 | Fisher | 339/220 R X |

*Primary Examiner*—Thomas J. Kozma
*Attorney, Agent, or Firm*—Frederick W. Raring

[57] ABSTRACT

An electrical connection of a terminal to a fine wire comprises a terminal post having a free end and a fixed end. The wire extends along the post and is wrapped therearound intermediate the ends of the post. The terminal has a generally U-shaped cross secton and is crimped onto the post with the web portion of the terminal against the windings. The surface of the web has serrations which penetrate the varnish type insulation of the wire and establish the electrical contact. The terminal and the terminal post have features which ensure the achievement of the electrical contact without damage to the extremely fine wire.

10 Claims, 9 Drawing Figures

Fig 1
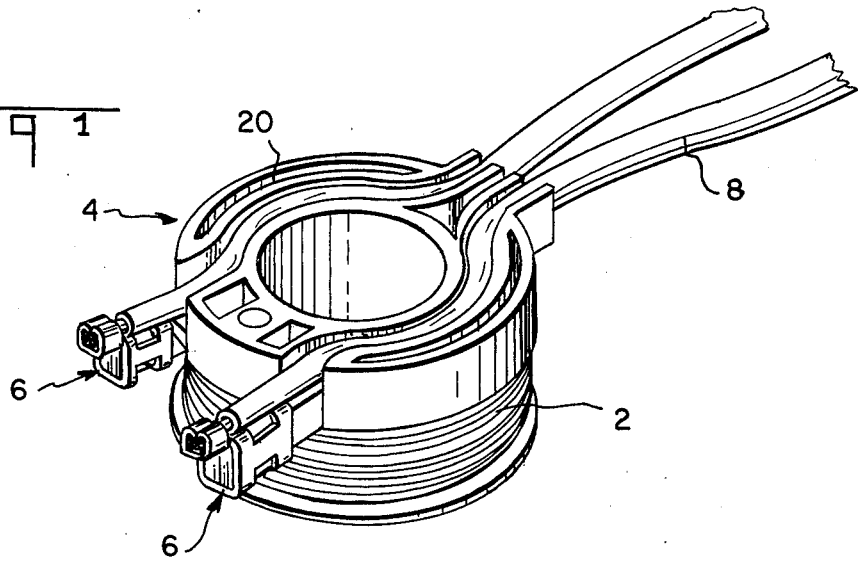
Fig 2
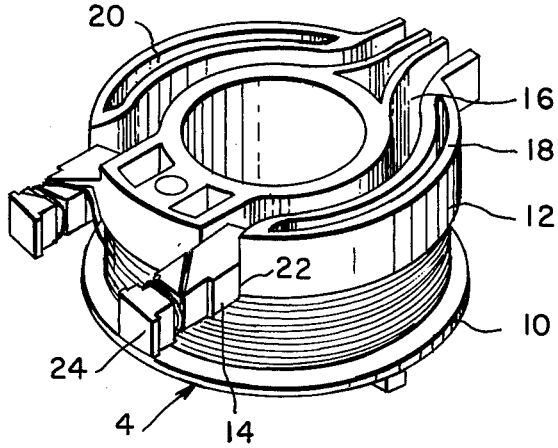
Fig 3
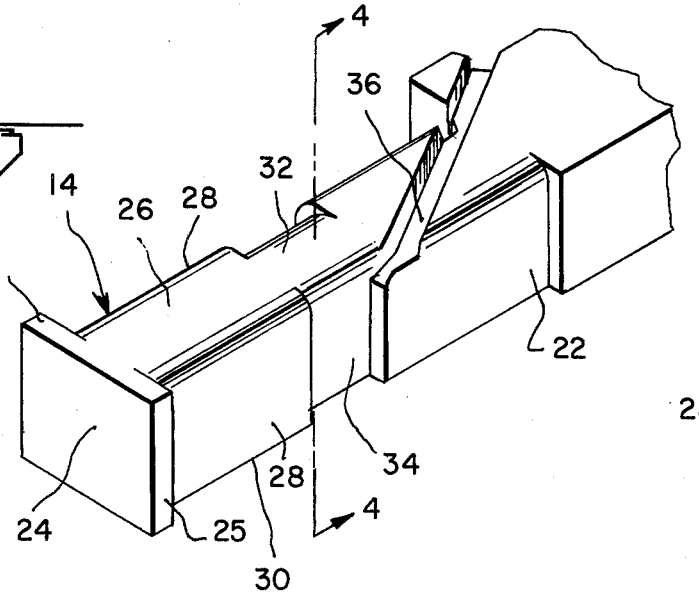
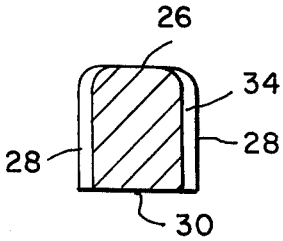
Fig 4

ELECTRICAL CONNECTIONS FOR EXTREMELY FINE WIRES

BACKGROUND OF THE INVENTION

This invention relates to electrical connections for extremely fine wires (wires in the range of AWG 32–50) of the type widely used for the windings of small electrical coils. The herein disclosed embodiment of the invention is specifically intended for connecting relatively coarse insulated wires (e.g. AWG 20 wires) to the extremely fine wires of a coil wound on a bobbin. However, the principles of the invention can be used under other circumstances where connections to extremely fine wires are required.

Electrical coils, such as induction coils, composed of extremely fine wires are widely used in many branches of the electrical industry and it is quite often a requirement that the coil windings be connected to relatively coarse insulated wires which extend to the coil. In the past, it has been common practice to achieve these electrical connections by providing solder terminals on the bobbin on which the coil is wound and soldering both the external wire and the coil wire to the solder post. More recently, connecting devices for coil wires have become available which have wire-receiving slots therein, the slots being dimensioned to receive the coil windings and the external wires, see, for example, U.S. Pat. No. 3,979,615. These wire-in-slot or "displation" connecting devices are now being widely used and are replacing soldered connections to a large extent for many types of windings. However, if the coil windings are of wires smaller than about AWG 28 or 30, it is often impractical to use a displation type of electrical connection. For example, a AWG 50 wire has a diameter of about 0.001 inches and a slot dimensioned to receive an AWG 50 wire would, of necessity, have a width of less than 0.001 inches. The manufacturer of terminal devices having wire-receiving slots therein of one thousandths of an inch or less is a practical impossibility, and the solder technique is, therefore, still being widely used for connections to coil wires in these extremely fine size ranges.

In accordance with the principles of the instant invention, a terminal post of firm insulating material is provided which may be integral with a coil bobbin and the fine wire of the coil winding is wrapped around an intermediate portion of this terminal post. The electrical connection is achieved by providing a generally U-shaped terminal and crimping the terminal onto the post with the web portion of the terminal bearing against the fine wire windings on the post. The web portion of the terminal is, moreover, a spring which normally extends arcuately inwardly between the sidewalls of the terminal so that when the terminal is crimped onto the post, the arcuate web is partially straightened. As a result, the web is compressively stressed along its length and is resiliently urged against the fine wire windings. The post and the terminal are designed such that the windings on the post are not disturbed when the terminal is crimped thereon and are not contacted other than by the web. An effective electrical connection is achieved not withstanding the frailty of the wire and the wire itself is not damaged. The terminal, on the other hand, is sufficiently massive to permit its being crimped onto a relatively coarse wire which extends from the bobbin.

It is accordingly an object of the invention to provide an electrical connection to an extremely fine wire of the type used for coil windings. A further object is to provide an electrical connection between a relatively coarse wire and an extremely fine wire. A further object is to provide an electrical connection for connecting external wires to the fine wires of a coil winding. A further object is to provide a solderless connection between an extremely fine coil winding and a coarse wire extending from the winding.

These and other objects of the invention are achieved in preferred embodiments thereof which are briefly described in the foregoing abstract, which are described in detail below, and which are shown in the accompanying drawing in which:

FIG. 1 is a perspective view of a coil bobbin having a fine wire coil wound thereon and having electrical connections to the coil windings in accordance with the invention.

FIG. 2 is a view similar to FIG. 1 showing the manner in which the fine wires of the coil are wrapped around the terminal posts which are integral with the bobbin.

FIG. 3 is an enlarged perspective view of one of the terminal posts.

FIG. 4 is a view taken along the lines 4—4 of FIG. 3.

Figure 5:
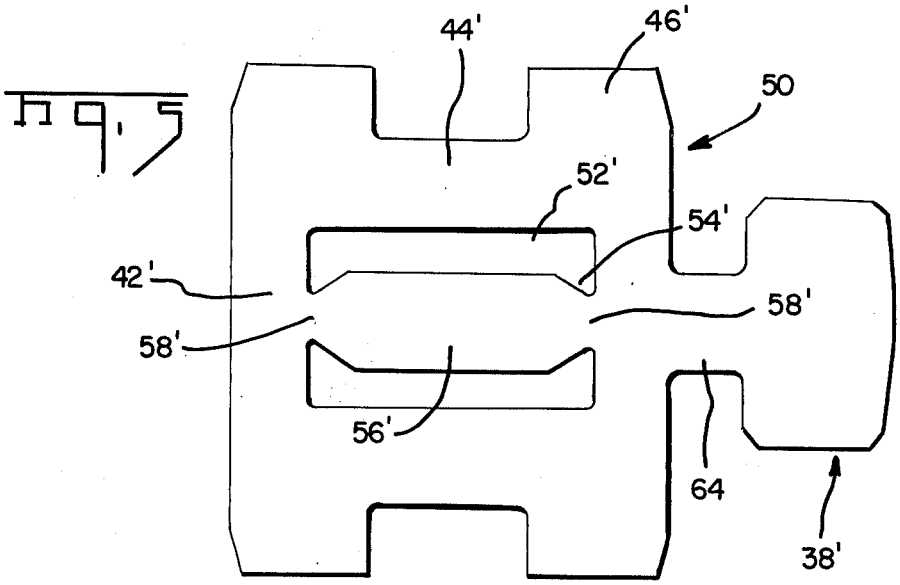
FIG. 5 is a plan view of the blank from which the terminal shown in FIG. 6 is formed.

FIG. 1 shows a typical coil bobbin 4 having a coil 2 wound thereon with the ends of the coil windings connected to wires 8 which extend from the bobbin. The windings 2 may be of extremely fine wires, for example, in the range of AWG 30–50 while the wires 8 will frequently be in the range of AWG 18–24. In accordance with the principles of the invention, the connections of the wires 8 to the ends of the coil wires are achieved by terminals 6 which are crimped onto terminal posts 14 and which are also crimped onto the ends of the wires 8 as shown.

The bobbin 4 is generally cylindrical and has end flanges 10, 12 between which the fine wire windings 2 are provided. The flange 10 is relatively thin while the flange 12 is comparatively wide and has integral terminal posts 14 extending therefrom. Channels 16 are provided in the face 18 of the flange 12 and extend from the fixed ends of the terminal posts 14 around the flange to the opposite side thereof. Additional openings 20 may be provided in the face 18 as required or as dictated by molding requirements. The channels 16 receive the wire 8 as shown in FIG. 1 and as will be explained below. The bobbin 4 may be molded of suitable insulating material and should, for purposes of the instant invention, be of a relatively firm material such as glassfilled nylon.

Each terminal post 14 has a fixed end 22 and a free end 24, laterally extending ledges 25 being provided on the free end to assist in locating the terminal on the post at the time of crimping. The upwardly facing (as viewed in the drawing) side 26 of the post constitutes the wire connecting side and a contact zone 32 is located centrally on this side and a contact zone 32 is located centrally on this side. Transversely extending recesses or grooves 34 are provided on the sides 28 which adjoin the side 26 and these grooves extend from the contact zone 32 to the underside 30 of the post. A channel 36 is provided in each post for the portion of the wire which extends from the coil winding to the contact zone.

Each terminal 6 (FIG. 6) comprises a generally U-shaped crimp portion 38, and a U-shaped fine wire contact portion 40 with the sidewalls 44 of the fine wire contact portion extending in a direction opposite to that of the sidewalls 68 of the crimp portion 38. The outer ends of the sidewalls 44 are flared laterally outwardly as shown at 46 to facilitate placement of the terminal on the post in an orientation such that the underside of the web 42 of the contact portion 40 is against the turns of the fine wire which are wrapped over the contact portion and which are received in the recess 34 as will be explained below. Transversely extending serrations are provided on the underside of the web for penetrating the varnish type insulation of the fine wire and establishing the electrical contact. It will also be noted that the sidewalls 44 are centrally notched as shown at 48, the purpose of these notches being to avoid physical contact between portions of the terminal and the fine wire windings on the post.

Each terminal 6 is produced from suitable strip metal stock by stamping and forming operations, the blank 50 from which the terminal is formed being shown in FIG. 5. Corresponding structural features of the blank and the formed terminal 6 are indicated with the same reference numerals differentiated by prime marks. At the time of blanking, parallel slots 52' are provided on the blank on each side of the center line and these slots are enlarged at their ends so that the central portion 56' of the web is connected to the ends of the blank by relatively narrow transition sections 58'.

Figure 6:
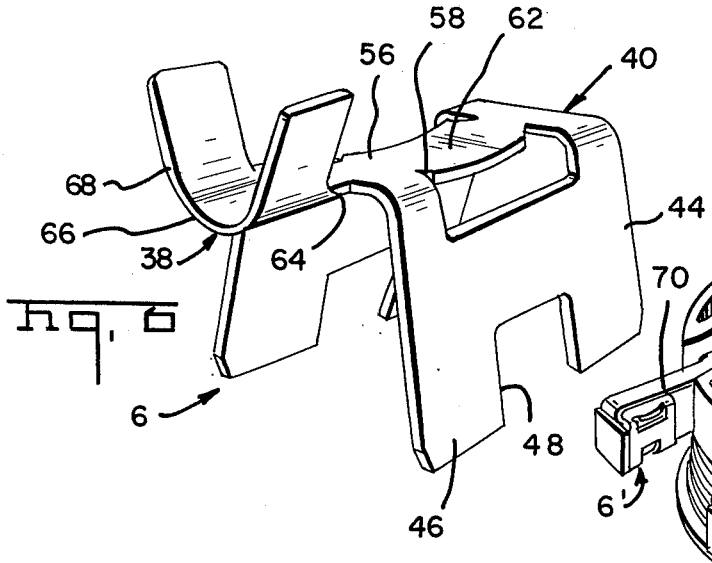
FIG. 6 is a perspective view of a terminal prior to its being crimped onto the terminal post.

The finished terminal 6 is formed by bending the sidewalls normally of the plane of the web of the blank and at this time, the isolated central section 56' of the web is formed inwardly of the sidewalls so that it extends arcuately between the sidewalls with the previously identified serrations located at the innermost portion of the web 62. The inward formation of the web 56' results in relatively extreme cold working or permanent deformation of the narrow connecting sections 58 and the finished web functions as a spring which can be flexed towards the original plane of the web from the position shown in FIG. 6. The normal condition of this spring is as shown in FIG. 6 and when it is partially straightened as will be described below, it is compressively stressed and along its' length has an inherent tendency to return to its normal configuration as shown in FIG. 6.

The wire crimp portion 38 is connected to the fine wire contact portion by means of a narrow or relatively short neck 64 which extends to the web 66 of the wire cirmp portion. The wire crimp portion can be dimensioned for any desired size wire 8 and is crimped onto the wire 8 in the conventional manner.

The completed coil assembly of FIG. 1 is produced by first winding the fine wire on the bobbin and at the conclusion of the winding operation, placing the end portions of the wire in the channels 36 which extend from the fixed ends 22 of the terminal posts across the surface 26 to the recesses 34. The end portion of the wire is then wrapped around the post at the contact zone 32 with the windings located in the recesses 34 and extending across the contact zone. Several turns may be taken around the post so that the wire will be retained on the post temporarily and until the terminal is crimped onto the post. The operation of placing the wires in the recesses 36 and wrapping them around the central portions 32 of the posts are very similar to present practice in the coil winding art of wrapping the ends of the wires around solder tabs and these operations can be carried out with previously known conventional coil winding machines.

Figure 7:
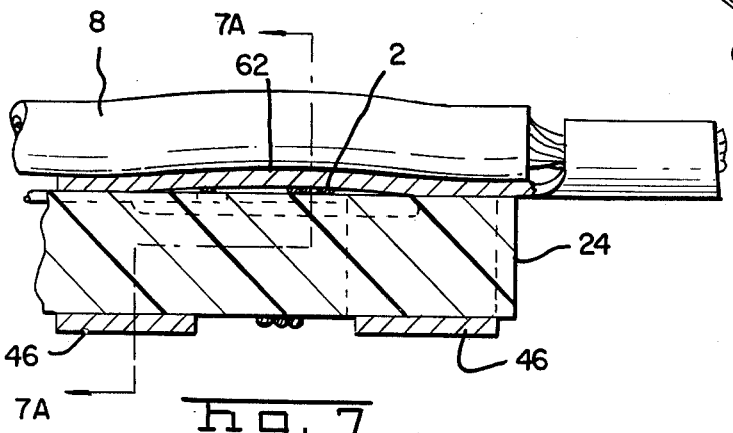
FIG. 7 is an enlarged side view of a post having a terminal crimped thereon.
Figure 7A:
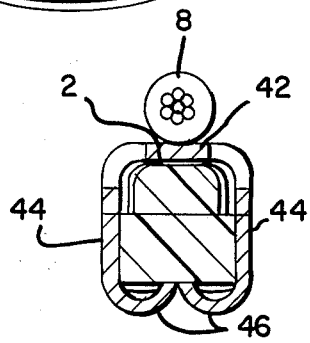
FIG. 7A is a view taken along the lines 7A—7A of FIG. 7.

After the ends of the wires have been wrapped around the terminal posts, terminals 6 are placed on the post with the undersides of the springs 56 against the portions of the wires which are disposed on the contact surfaces 32. The terminals are then crimped to the post by simply bending the sidewalls 44 inwardly towards each other and against the undersides 30 of the terminal posts as shown in FIG. 7A. These operations can be carried out by suitable applicators or by hand tools. The terminals should be snuggly mounted on the terminal posts so that the contact springs 56 are at least partially straightened as the web portions of the terminals are pulled against the surface 26 of each post. This partial straightening of the contact springs 56 results in the development of relatively high logitudinal compressive stresses in the springs 56 which continually urge the springs against the portions of the wires which extend over the contact zones. The serrations on the terminals penetrate the varnish type insulation of the wires 2 and establish electrical contact.

It will be noted that the fine wire windings on the posts are contacted between terminal only at the contact zone 32 and in this zone, the underside of the spring bears normally against the wires so that there is little or no liklihood of damage to the extremely fragile wires. The portions of the wire windings which are in the recess 34 and which extend across the undersides 30 of the terminal posts are not contacted by the terminals in any manner so that the possibility of fracturing the wire during the crimping operation is avoided.

After the terminals have been crimped onto the terminal posts, the stripped ends of the coarse wires 8 are connected to the terminals by crimping the wire crimp portions 38 of the terminals onto the wire ends. In the disclosed embodiment of FIG. 1, the wires extend from the crimped connections 68 along the posts and through the channels 16 as shown. This arrangement provides a strain relief for each wire 8 and the wires are neatly arranged and held in the vicinity of the bobbin.

The principles of the invention can obviously be used for electrical connections with wires in a wide range of AWG gauges. However, as previously noted, the invention is particularly advantageous when it is necessary to establish contact with wires in the range of AWG 30–50. A suitable terminal for wires in this size range is such that the length of the fine wire contact portion 40 is about 0.0300 inches and the posts are substantially square and have a width of about 0.100 inches. These dimensions are about the same as those of previously used solder tab type connections on coils of comperable sizes. The terminals can be produced of any suitable material having moderate spring properties, such as a suitable copper base alloy, from stock having a thickness of about 0.010 inches. It will be apparent that since electrical contact is established when the terminal is crimped onto the post by the resilient compressive forces which urge the spring against the turns of wire on the post, a wide range of wire sizes can be accommodated by the single terminal size.

Figure 8:
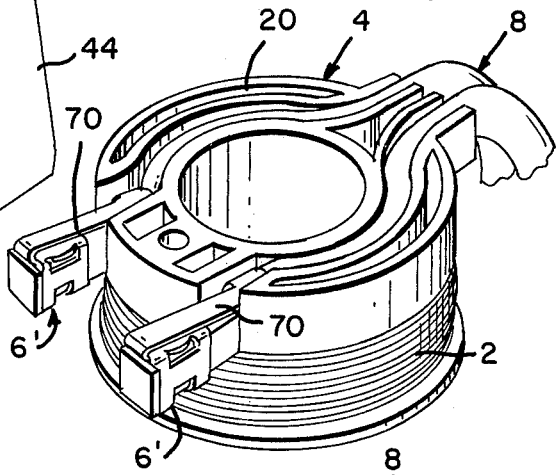
FIG. 8 is a view similar to FIG. 1 illustrating the use of an alternative form of terminal.

FIG. 8 shows an alternative embodiment in which the wire crimp portion 38 of the terminal is connected to the fine wire contact portion 40 by a realtively long connecting neck 70. After the external wires 8 have been crimped onto the wire crimp portion, this neck is reversely bent at a location adjacent to the fine wire contact portion and the crimped connection to the wires 8 can thereby be placed in the recess 16 as shown in FIG. 8. The embodiment of FIG. 8 reduces the overall dimensions of the assembly by an amount equal to the length of the crimped connections between the wire 8 and the terminal and this embodiment also provides a section of the connecting neck 70 above the terminals. Under some circumstances, this section of the connecting portion 70 may be desirable for its protective function.

What is claimed is:

1. A stamped and formed terminal which is intended to be crimped onto a terminal post to establish electrical contact with a wire which has been wrapped around said post;

said terminal being generally U-shaped in cross section and comprising a web portion and sidewalls, side-by-side slots in each of said sidewalls extending from a location adjacent to each end of said terminal, each of said slots being at the base of its respective sidewall so that a central portion of said web is isolated from said sidewalls, said central portion of said web being inwardly deformed with respect to said sidewalls along the axis of said terminal whereby, upon crimping said terminal onto said post, said web is partially straightened with accompanying compressive resilient deformation thereof, and said web is thereby resiliently urged against said wire thereby to establish electrical contact with said wire.

2. A terminal as set forth in claim 1, said central portion of said web having serrations in its internal surface for penetrating varnish-type insulation on said wire.

3. A terminal as set forth in claim 2, each of said sidewalls having a centrally located notch therein, said notches providing clearance for said wire upon crimping said terminal onto said post.

4. A terminal as set forth in claim 3, said terminal having an additional crimp portion integral therewith for crimping said terminal to an additional wire, said additional crimp portion being integral with, and extending from, said web.

5. An electrical connection of a terminal to a fine wire comprising:

a terminal post of insulating material, said post having a generally rectangular cross section and having a free end and a fixed end, a wire contact zone on one side of said post intermediate said ends, the two sides of said post which adjoin said one side being provided with grooves extending thereacross to said wire contact zone, said wire being wrapped around said post at said wire contact zone with portions of said wire being disposed in said grooves, said terminal being generally U-shaped in cross section and comprising a web and sidewalls, said web being against said one side of said post and said sidewalls being against said sides which adjoin said one side, portions of said sidewalls being bent inwardly and being against the side of said post which is opposite to said one side, said terminal having slots therein extending along said sidewalls intermediate the ends thereof, said slots isolating said web from said sidewalls, said web being in a compressively stressed condition along its length and having a resilient bias against said one surface whereby said web is resiliently urged against said wire and is thereby in electrical contact with said wire.

6. An electrical connection as set forth in claim 5, each of said sidewalls having a centrally located notch therein, said notches providing clearance for said wire.

7. An electrical connection as set forth in claim 5, said terminal having a coarse wire connecting portion extending from the end of said web which is adjacent to said free end of said post, and a coarse wire connected to said terminal at said coarse wire connecting portion.

8. An electrical connection as set forth in claim 7, said coarse wire connecting portion comprising a coarse wire crimp.

9. An electrical connection as set forth in claim 8, said post being integral with an insulating support at said fixed end, said fixed end being proximate to one surface of said support, said one surface having a coarse wire-receiving recess extending thereacross, said coarse wire extending from said coarse wire crimp over said web of said terminal, and being positioned in said recess.

10. The combination set forth in claim 9, said support comprising a coil bobbin.

* * * * *